US009291137B2

(12) United States Patent
Schmieder et al.

(10) Patent No.: US 9,291,137 B2
(45) Date of Patent: Mar. 22, 2016

(54) DEVICE FOR HOLDING DOWN A VALVE FOR METERING FUEL

(71) Applicants: Dietmar Schmieder, Markgroeningen (DE); Tilo Landenfeld, Vaihingen/Enz (DE)

(72) Inventors: Dietmar Schmieder, Markgroeningen (DE); Tilo Landenfeld, Vaihingen/Enz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 254 days.

(21) Appl. No.: 13/863,471

(22) Filed: Apr. 16, 2013

(65) Prior Publication Data

US 2013/0269646 A1 Oct. 17, 2013

(30) Foreign Application Priority Data

Apr. 17, 2012 (DE) ..... 10 2012 206 241

(51) Int. Cl.

| | |
|---|---|
| ***F02M 61/14*** | (2006.01) |
| ***F02M 55/00*** | (2006.01) |
| ***F01L 1/00*** | (2006.01) |
| ***F02M 55/02*** | (2006.01) |
| ***F02M 69/46*** | (2006.01) |

(52) U.S. Cl.

CPC *F02M 61/14* (2013.01); *F01L 1/00* (2013.01); *F02M 55/004* (2013.01); *F02M 55/025* (2013.01); *F02M 69/465* (2013.01); *F02M 2200/16* (2013.01); *F02M 2200/803* (2013.01); *F02M 2200/856* (2013.01)

(58) Field of Classification Search

CPC ... F02M 61/14; F02M 69/465; F02M 55/004; F02M 55/025

USPC ..... 123/470, 456, 468, 469, 467; 239/600

See application file for complete search history.

(56) References Cited

U.S. PATENT DOCUMENTS

| | | | | |
|---|---|---|---|---|
| 4,571,161 | A * | 2/1986 | Leblanc et al. | 417/499 |
| 6,148,797 | A * | 11/2000 | Gmelin | 123/456 |
| 6,758,416 | B2 * | 7/2004 | Earhart et al. | 239/533.2 |
| 7,415,970 | B2 * | 8/2008 | Zdroik et al. | 123/470 |
| 7,765,984 | B2 * | 8/2010 | Fuerst et al. | 123/456 |
| 2011/0186016 | A1 * | 8/2011 | Bolz et al. | 123/470 |

FOREIGN PATENT DOCUMENTS

| | | |
|---|---|---|
| DE | 197 58 817 | 8/2010 |

* cited by examiner

*Primary Examiner* — Mahmoud Gimie
(74) *Attorney, Agent, or Firm* — Kenyon & Kenyon LLP

(57) ABSTRACT

A device for holding down a valve for metering fuel in the cylinder head of an internal combustion engine is provided. The valve is inserted for fuel supply, using a connection piece, into a sealing region which presses against the connection piece at an outlet opening of a manifold fixed to the cylinder head. Between a first support shoulder on the side of the valve and a second support shoulder on the side of the manifold, the device has a clamped spring element for transferring a holding-down force onto the valve. In order to achieve an inward deflection of the spring element required for the transfer of the holding-down force, the spring element is prestressed to a prestressing force that is reduced with respect to the holding-down force, and the prestressed spring element is fixed on the valve.

13 Claims, 7 Drawing Sheets

DEVICE FOR HOLDING DOWN A VALVE FOR METERING FUEL

BACKGROUND OF THE INVENTION

1. Field of the Invention

The present invention relates to a device for holding down a valve for the metering of fuel in a cylinder head bore in the cylinder head of an internal combustion engine, which is plugged in, using a connection piece, to a sealing region pressing against the connection piece on an outlet opening of a manifold that is able to be fixed to the cylinder head for fuel supply.

2. Description of the Related Art

By "fuel," one should understand in this connection a fluid, that is, liquid or gaseous fuel whose chemical energy is transformed by combustion in an internal combustion engine, such as an Otto engine, a Diesel engine or a gas engine into a driving force.

One known mounting support for a fuel injector on the cylinder head of an internal combustion engine, described in published German patent document DE 197 58 817 B4, has a spring element developed as a helical compression spring, which is clamped in between a first support shoulder developed on the valve and a second support shoulder developed on the fuel manifold and encloses the valve in such a way that a spring force in the direction of the longitudinal axis of the valve is able to be transferred to the valve. The support shoulders are developed as annular mountings and face each other in the mounted state. The fuel manifold has a connection piece for each valve, known also as a connecting cup, having a fuel outlet opening at the base. Into the connection piece an intermediate sleeve is installed that encloses the outlet opening in a sealing manner, and is fixed on the fuel manifold using a securing element that grasps the connection piece from the outside. The intermediate sleeve, within certain limits, permits a flexible connection of the outlet opening of the fuel manifold with the connection piece of the valve that dips into the intermediate sleeve. Between connection piece and intermediate sleeve a sealing ring has been inserted that presses against the connection piece.

During assembly, the spring element is pushed onto the intermediate sleeve, and the valve with its connection piece is pushed into the connection sleeve. As long as the spring element remains unstressed, the friction of the sealing ring is sufficient to hold the valve on the fuel manifold. The subassembly of valve and fuel manifold is mounted on the cylinder head in that the valve is set into the cylinder bore and the fuel manifold is pressed down until a holding piece that is on the fuel manifold makes contact with a holding base that projects from the cylinder head. Because of the great guidance length of the connection piece present in the intermediate sleeve, it is possible to compress the spring element from its unstressed position to such an extent that, upon contact of holding piece and holding base, the desired holding-down force is transferred axially to the valve. Using a cap screw guided through the holding piece, the fuel manifold is screwed down in the holding base.

BRIEF SUMMARY OF THE INVENTION

The device for holding down a valve for metering fuel according to the present invention has the advantage that, based on the prestressing present of the spring element upon mounting of the subassembly made up of the valve and the manifold on the cylinder head in the sealing region of the fuel, only a short free path still has to be available for the displacement of the connection piece, in order to transfer the desired holding-down force to the valve, by the compression of the already prestressed spring element, which is brought about by the axial displacement of the second shoulder during the tight clamping of the manifold on the cylinder head. With that, an additional connecting sleeve in the connecting cup of the manifold may be omitted, and the connection piece may be inserted directly into the axially short connecting cup. Besides the savings in components, the overall axial length of the holding device is clearly diminished and the subassembly of manifold and valve becomes substantially more compact.

The possibility of preassembly of valve and manifold remains intact, since the spring element restrained with prestressing at the valve generates no spring force between the two support shoulders when the connection piece is pushed into the sealing region, and the friction in the sealing region is enough to hold the injector on the manifold. In spite of the only brief guiding length for the connection piece in the sealing region, a spring element having small spring constants or spring stiffness is able to be used. A small spring constant is important in order to achieve an at least approximate maintaining of the desired holding-down force, independently of the unavoidable large tolerance range in the axial separation distance of the two support shoulders, so that a so-called noise disk, situated between the cylinder head and the injector, is able to be used which, for optimal noise damping, has to be made of a soft material, without suspension of its performance reliability.

According to one advantageous specific embodiment of the present invention, a helical compression spring is used as the spring element. Such a helical compression spring, for transmitting a predefined holding-down force, may be designed to have small spring constants or spring stiffness, so that greater distance tolerances between the support shoulders on the manifold and the valve may be admissible, without the holding-down force deviating substantially from the specified value after final assembly. Based on the small spring stiffness, the specified value may be held small, so that a noise disk made of a soft material may be used for optimal noise damping.

According to one advantageous specific embodiment of the present invention, the fixing of the prestressed spring element on the valve is undertaken, using a securing member situated on the valve, and an annular support disk, that is situated concentrically to the connection piece, is assigned to the spring element, which, on its disk surfaces facing away from each other, each has a support region for the manifold-side second support shoulder, and cooperates with the securing member. Using the support disk, the spring element may be transferred by the second support shoulder from its prestressed position to its end position transmitting the holding-down force, depending on the constructive embodiment of the securing member, without the securing member or via the securing member.

According to one advantageous specific embodiment of the present invention, the supporting disk is situated on the connection piece in an axially displaceable manner, and the securing member is formed by an axial stop for the supporting disk that is fixed on the connection piece.

According to alternative specific embodiments of the present invention, the axial stop may be implemented using a snap ring which is inserted into an annular groove worked into the connection piece, or using an annular radial shoulder that is formed into or onto the connection piece, in the latter case, for putting the supporting disk on the connection piece, the supporting disk being provided at its inner edge with radial spring projections that stick out, and engage behind the radial shoulder and are able to slide on the connection piece. The radial shoulder is advantageously formed, in this context, by a groove side of an encircling groove worked into the connection piece, having an axial groove height that is sufficiently great for the spring deflection of the spring element.

According to one advantageous specific embodiment of the present invention, the connection piece is axially at a distance from a connecting body that closes at its end face a valve housing of the valve, and at the connecting body the first support shoulder for the spring element is developed and the securing member is fixed for the prestressed spring element. The connecting body, in this instance, may have a connecting piece that is set into the valve housing having a supply bore continuing from the connection piece, and a plastic part mounted on the connecting piece. On the plastic part, the first support shoulder for the spring element is then developed and the securing member for the prestressed spring element is fixed. The plastic part is either mounted as a separate module component on the connecting piece and clamped in a fixed manner with force-locking on the connecting piece or is sprayed on as a plastic coating on the connecting piece.

The securing member situated on the connecting body may be implemented constructively in various advantageous ways.

Thus, according to one advantageous specific embodiment of the present invention, the securing member has a plurality of snap-on hooks, integrally molded on the connecting body, having hook shanks and hook projections, the hook shanks extending parallel to the connection piece and the hook projections engaging over the disk surface of the support disk, facing away from the spring element, outside the second support for the manifold-side second support shoulder. The snap-on hooks, in this context, may additionally be drawn upon to secure the valve against rotation relative to the manifold, in that, in the manifold, axial grooves are provided into which the hook noses run when the connection piece is pushed into the sealing region on the manifold.

Alternatively, according to one further specific embodiment of the present invention, the connecting body has a region shaped like a pot, having a pot bottom that forms the first support shoulder on the valve side, and a pot jacket situated concentrically to the supply piece, and the securing member has a clamp having two clamp legs connected to each other by a crosspiece. The clamp legs are inserted axially with form-locking in two transverse grooves developed diametrically in the pot jacket and extend over the supporting disk on its disk surface facing away from the spring element outside the second support region for the second support shoulder on the side of the manifold.

In an additional specific embodiment of the present invention, the supporting body has a hollow cylindrical region that concentrically surrounds the connection piece, having a cylinder wall whose annular end face forms the first support shoulder, on the side of the valve, for the spring element. The two diametrically situated transverse grooves having groove openings facing away from each other, and an axial groove height which is adjusted to the spring excursion of the spring element required for the transfer of the holding-down force, are worked into the cylinder wall. The securing member has a bracket having two fork-shaped bracket legs connected to each other by an axial crosspiece, of which the one bracket leg is inserted into the transverse grooves and the other bracket leg extends over the supporting disk on its disk surface, facing away from the spring element, within the second supporting region for the second support shoulder on the side of the manifold, so that the bracket participates in the displacing motion of the second support shoulder on the side of the manifold, and, on its part, stresses the spring element to produce a holding-down force.

In these alternative specific embodiments, too, of connecting body and securing member, the connecting body may be drawn upon for producing an antitwist protection for the valve, in that, on the connecting body, a crosspiece is formed on that extends parallel to the connection piece, and on the manifold, an axial groove is provided for introducing the crosspiece during the production of the connection of valve and the manifold.

DETAILED DESCRIPTION OF THE INVENTION

Figure 1:
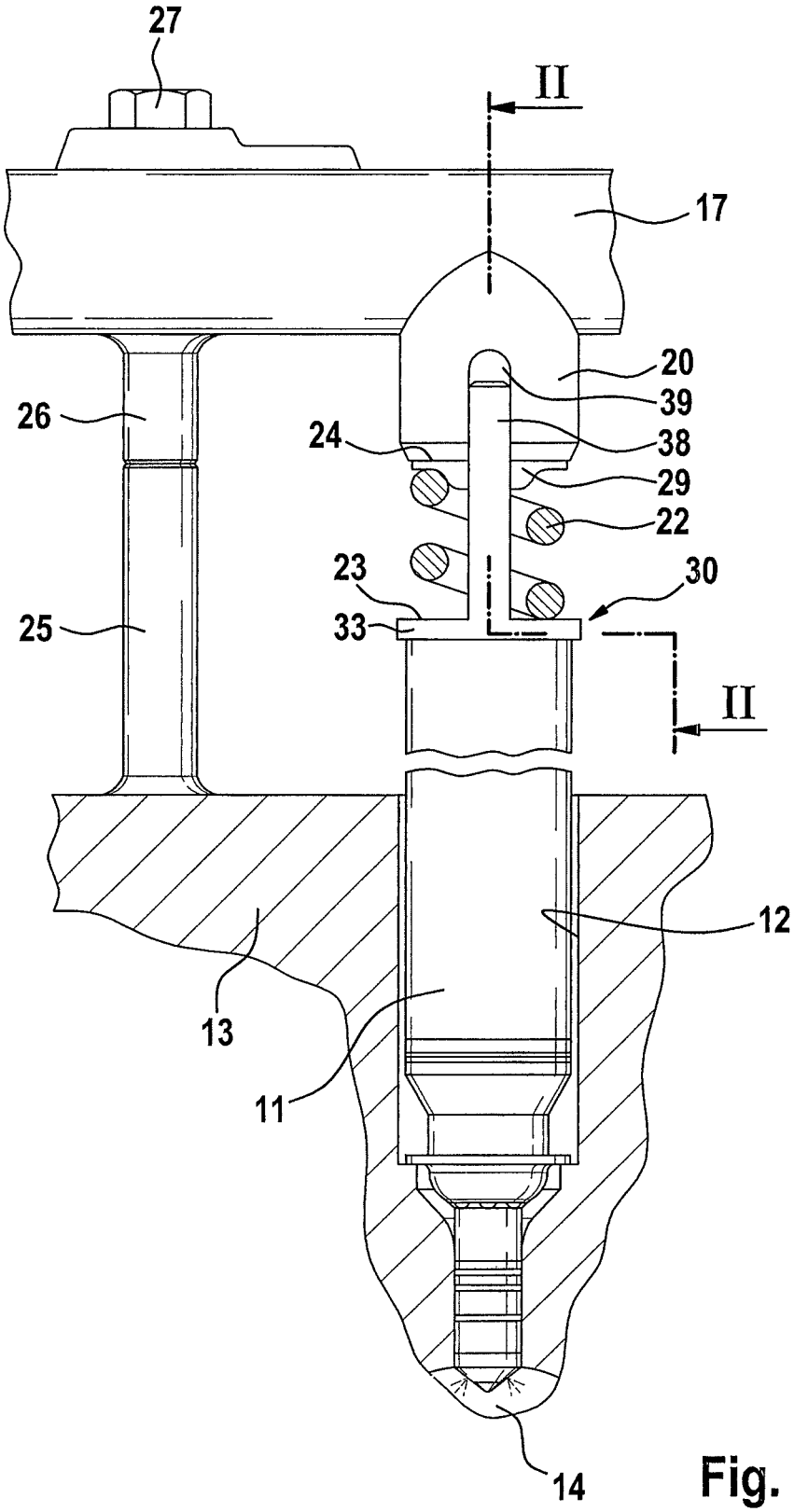
FIG. 1 shows a device for holding down a valve for metering fuel showing in cutout a distributor for fuel supply and a cylinder head of an internal combustion engine.

In the various exemplary embodiments shown fully (FIG. 1) and in the form of cutouts (FIG. 2 through 13) of the device for holding down a valve 11 for metering fuel in internal combustion engines, valve 11 is inserted into cylinder head bore 12 in a cylinder head 13 shown only as a cutout in section in FIG. 1. Cylinder head bore 12 opens out into combustion chamber 14 of the internal combustion engine, to which fuel that is under operating pressure is metered in dosing fashion. Using a connection piece 15 (FIG. 2), valve 11 is connected to a connecting opening 16 of a manifold 17 for fuel supply, connection piece 15 being inserted into a sealing region 18 that is preconnected to outlet opening 16, the sealing region pressing against connection piece 15. Sealing region 18 is implemented by a radial seal 19, which is situated in a connecting cup 20 that is formed on manifold 17 and is fixed, axially immovably, using a spring ring 21 and two sealing disks.

The device has a spring element 22, which is clamped in a first support shoulder 23 that is on the side of the valve and a second support shoulder 24 that is on the side of the manifold, and transfers a holding-down force F1 to valve 11. Spring element 22 is advantageously developed as an helical compression spring, in order to achieve a small spring constant or spring stiffness of spring element 22. Manifold 17 is fixed to cylinder head 13, for which, on cylinder head 13, a holding column 25 and on manifold 17 a holding piece 26 are situated. Holding column 25 and holding piece 26 lie one on top of the other in response to the transfer of holding-down force F1 by the stressed spring element 22 and are fixedly connected to each other by a cap screw 27 that is guided through holding piece 26.

Figure 3:
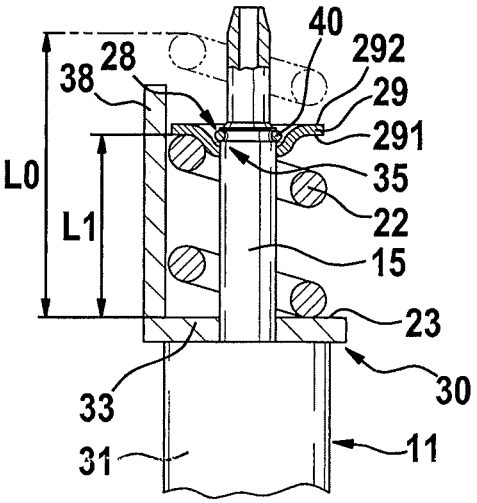
FIG. 3 shows a section corresponding to the section shown in FIG. 2, with the distributor removed from the valve.

As is best seen in FIG. 3, in the case of valve 11, that is detached from manifold 17, spring element 22 is stressed to a stressing force that is reduced compared to holding-down force F1, and prestressed spring element 22 is fixed on valve 11. For this, spring element 22 is deflected inwards from L0 to L1, that is, the unstressed length L0 of the helical compression spring is compressed to a working length L1, and in this position it is fixed to injector 11. The prestress force of spring element 22 that is thereby set, i.e. working length L1 of the helical compression spring, is dimensioned so that a free path a (FIG. 4) for the displacement of connection piece 15 in sealing region 18 is sufficient to stress spring element 22 from prestress force to holding-down force F1, that is, to compress the helical compression spring from its working length L1 to working length L2.

Figure 2:
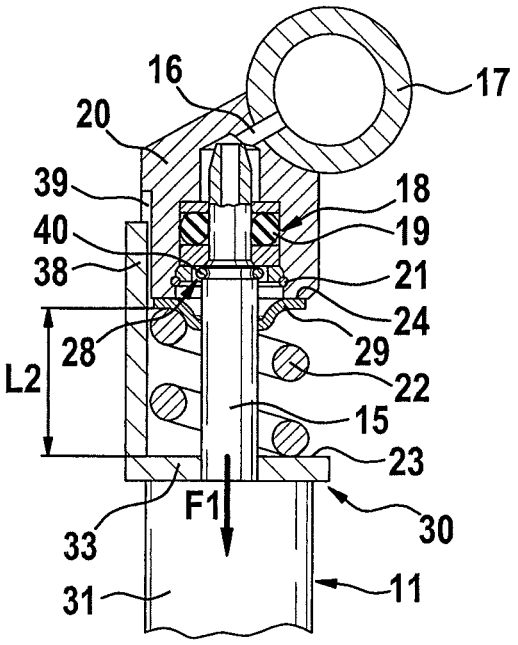
FIG. 2 shows, in a cutout, a section along line II-II in FIG. 1.

The representations in FIG. 3, FIG. 4, FIG. 2 and FIG. 1 enable one to recognize the assembly of the device in the sequence named. According to FIG. 3, spring element 22 is first set to spring excursion S1=L0−L1, that is, helical compression spring is compressed from its unstressed length L0 to working length L1, and prestressed spring element 22 is fixed to valve 11. After that, valve 11 together with prestressed spring element 22 is inserted into sealing region 18 on manifold 17 until second support shoulder 24 on the manifold side lies against prestressed spring element 22 without pressure. Because of its contact pressure on connection piece 15, sealing region 18 on manifold 17 produces a sufficiently great force to hold connection piece 15 in sealing region 18, so that the connection of valve 11 and manifold 17 are not detached during transportation and further assembly. The subassembly thus preassembled of manifold 17 and one or more valves 11 (FIG. 4) is applied to cylinder head 13, each valve 11 being inserted into a cylinder head bore 12. After the insertion of valve or valves 11 into respective cylinder head bore 12, manifold 17 is displaced in the direction of cylinder head 13, second support shoulder 24 on manifold 17 further compressing spring element 22, that is, reducing the working length of the helical compression spring from L1 (FIG. 4) to L2 (FIG. 2). In the process, connection piece 15 in sealing region 18 shifts by the path a. In this position, holding piece 26 meets holding column 25, and manifold 17 is screwed onto cylinder head 13 (FIG. 1). Spring element 22 deflected inwards to L2, that is, the helical compression spring set to working length L2, transfers holding-down force F1 (FIG. 2) to valve 11, which is thereby set reliably, in a fixed manner, in cylinder head bore 12.

The fixing of prestressed spring element 22 is undertaken using a securing member 28. An annular support disk 29 is assigned to spring element 22 for this, which is situated concentrically to connection piece 15, and which has, on disk surfaces facing away from each other, in each case a first support region 291 for spring element 22 and a second support region 292 for second support shoulder 24 on manifold 17, and collaborates with securing member 28 (FIG. 3).

Valve 11 has a valve housing 31, which is closed off at its end face that projects from cylinder head bore 12 by a connecting body 30 from which connection piece 15 is axially at a distance. First support shoulder 23, for spring element 22, on the valve side is developed on connecting body 30, and second support shoulder 24 for spring element 22, on the manifold side, is formed by the cup rim of connecting cup 20 on manifold 17. Connecting body 30 may be developed in one piece, but is preferably composed of a metallic connecting piece 32 inserted into valve housing 31, which has a supply bore 34 that continues from connection piece 15, and a plastic part 33, which encloses connection piece 15 (FIG. 5). Plastic part 33 may either be designed as a separate module component mounted on connecting piece 32 and be held with force-locking on connecting piece 32 using spring element 22, or may be sprayed as a plastic extrusion onto connecting piece 32. First support shoulder 23 then is developed for spring element 22 on plastic part 33, and securing member 28 is fixed to it. In FIGS. 1, 2 through 4, 6, 7, 8, 9 and 10 through 13, only plastic part 33 is visible of connecting body 30.

Figure 4:
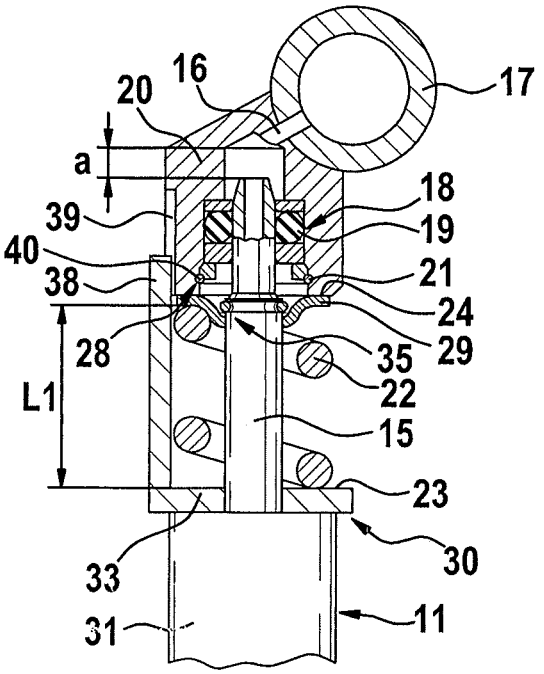
FIG. 4 shows a section corresponding to the section shown in FIG. 2, before final assembly, without transferring the holding-down force to the valve.
Figure 5:
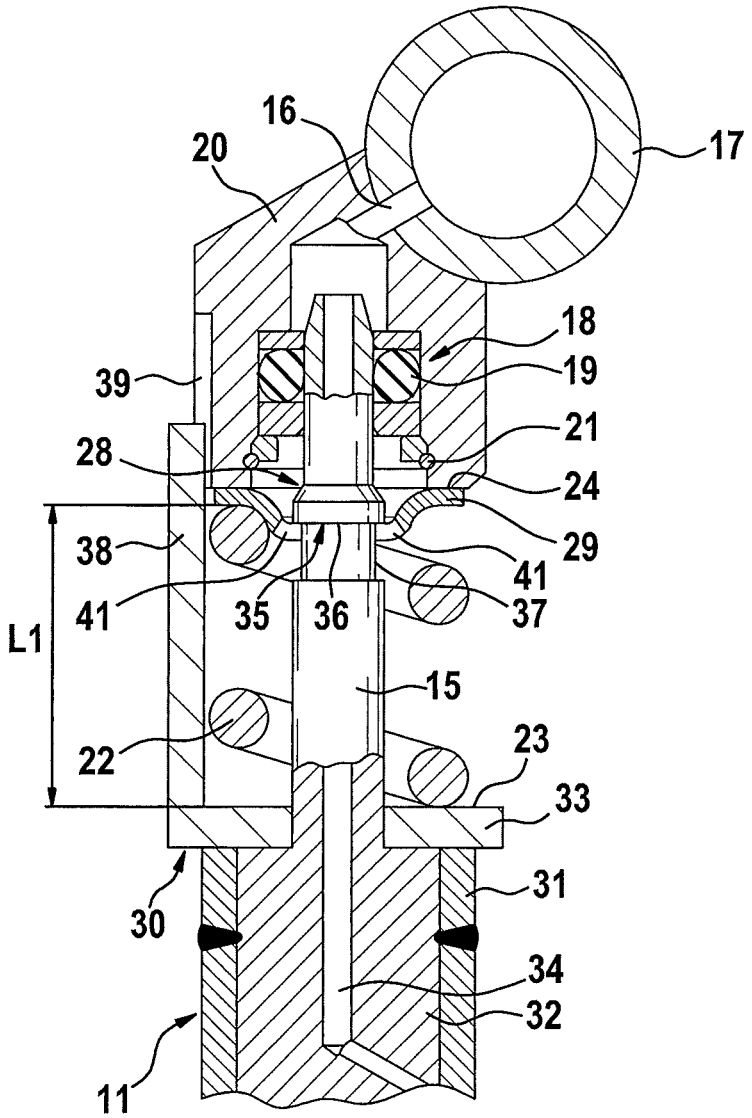
FIG. 5 shows a longitudinal section of the preassembled subassembly made up of distributor and modified valve according to a second exemplary embodiment before final assembly, without transferring the holding-down force to the valve.
Figure 6:
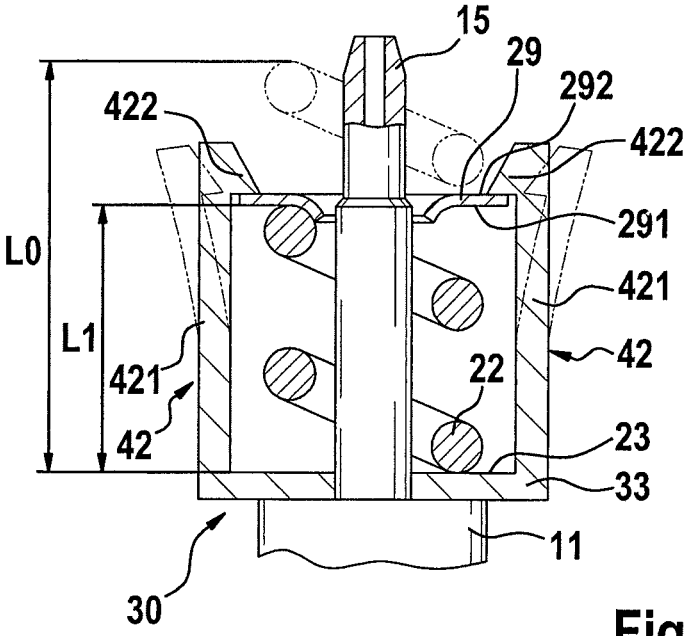
FIG. 6 shows a section corresponding to the section shown in FIG. 3, according to a third exemplary embodiment.

In the exemplary embodiment of FIGS. 2 through 4, and in the exemplary embodiment according to FIG. 5, support disk 29 is situated, axially displaceable, on connection piece 15 and securing member 28 is formed by an axial stop 35, fixed on connection piece 15, for support disk 29. This axial stop 35 is implemented, in the exemplary embodiment of FIGS. 2 through 4, by a spring ring 40, which is set into an annular groove worked into connection piece 15. In the exemplary embodiment of FIG. 5, axial stop 35 is implemented by a radial shoulder 36 formed into or onto connection piece 15. This radial shoulder 36 may be produced in a simple way by the groove side of a groove 37 that is worked into, and surrounds connection piece 15, groove 37 having a sufficiently large axial groove width in order to displace support disk 29 from position L1 in FIG. 5 into position L2 in FIG. 2. In order to enable assembly of support disk 29 onto connection piece 15, the inner edge of support disk 29 is provided with spring projections 41, which snap into groove 37, engage behind the groove side and stop support disk 29 under the prestressing force of spring element 22 on the side of the groove or radial shoulder 36.

In both exemplary embodiments according to FIGS. 2 through 4 and FIG. 5, an antitwist protection is provided, which reliably prevents rotation of valve 11 with respect to manifold 17. For this purpose, connecting body 30, or rather, plastic part 33 has at least one crosspiece 38 that extends parallel to connection piece 15, and connecting cup 20 on manifold 17 has an axial groove 39. When valve 11 is applied to manifold 17 and connection piece 15 is pushed into sealing region 18, crosspiece 38 is displaced, in the radial direction, into axial groove 29 with form-locking.

In the exemplary embodiments according to FIGS. 6 through 13, securing member 28 is not fixed on connection piece 15, but rather on connecting body 30 or plastic part 33. In the exemplary embodiment of FIGS. 6 and 7, securing member 28 has a plurality of snap-in hooks 42 having hook legs 421 extending in parallel to connection piece 15 and hook projections 422 that are in one piece with hook legs 421 but stick out from them. Snap-in hooks 42 are formed in one piece onto connecting body 30 or plastic part 33. Hook projections 422 engage over the disk area of support disk 29 facing away from spring element 22, outside second support region 292 for second support shoulder 24 on the side of the manifold. In the direction towards connection piece 15, hook projections 422 have abutting surfaces via which support disk 29 pivots snap-in hooks 42 outwards, in response to the transfer of spring element from position L0 into position L1. After position L1 is reached, snap-in hooks 42 pivot back again and engage over support disk 29 using hook projections 422.

Figure 7:
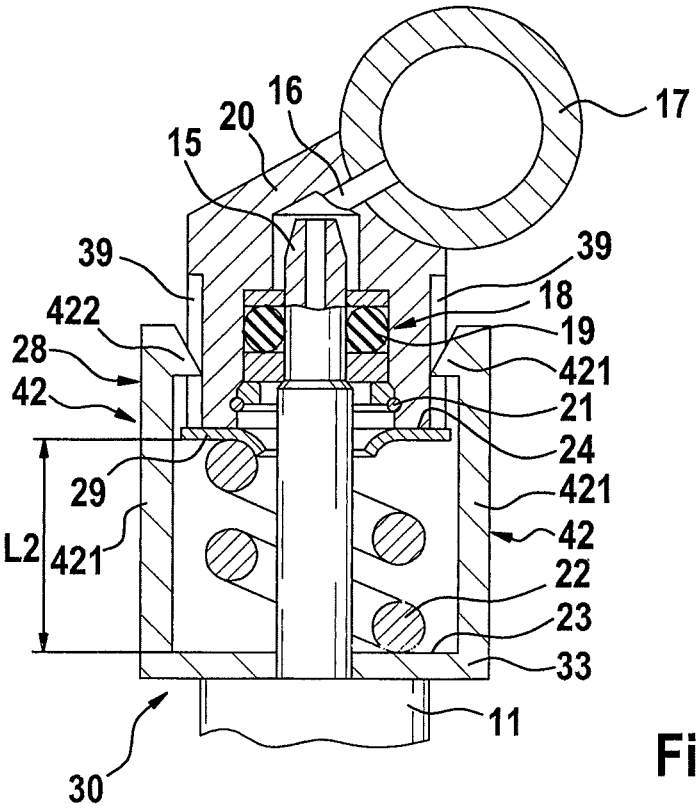
FIG. 7 shows a section corresponding to the section shown in FIG. 2, according to the third exemplary embodiment.

During the assembly of the device, second support shoulder 24 on manifold 17, formed by the annular cup rim of connecting cup 20, slides past hook projections 422 and displaces support disk 29 into position L2 (FIG. 7). Snap-in hooks 42 may be used at the same time for the antitwist protection of valve 11. In connecting cup 20, axial grooves 39 are provided for this, that are assigned to snap-in hooks 42, into which hook projections 422 of snap-in hooks 42 move in axially when valve 11 is set onto manifold 17 and connection piece 15 is pushed into sealing region 18.

Figure 8:
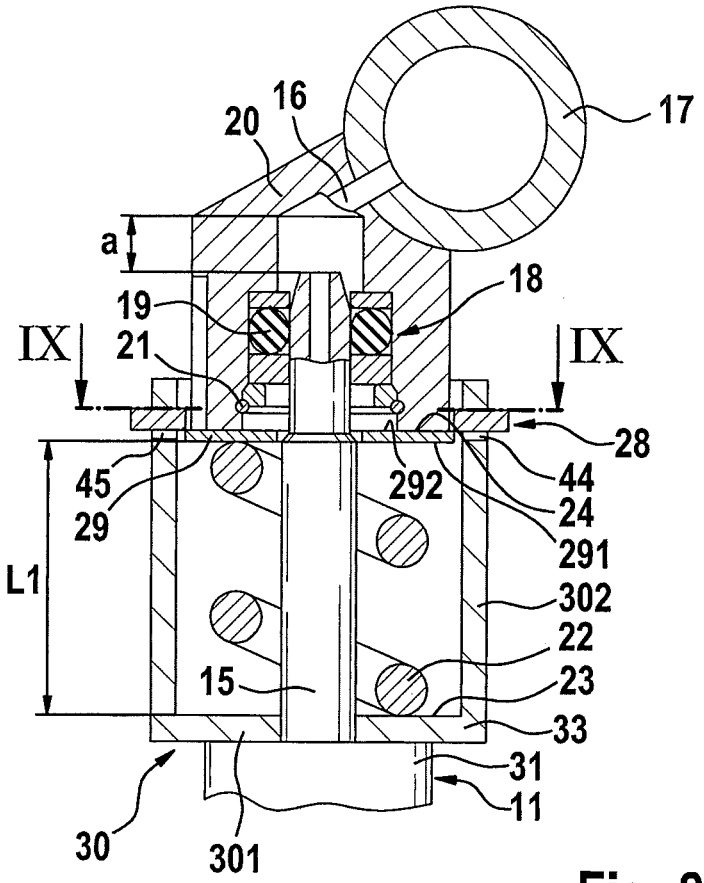
FIG. 8 shows a section corresponding to the section shown in FIG. 3, according to a fourth exemplary embodiment.
Figure 9:
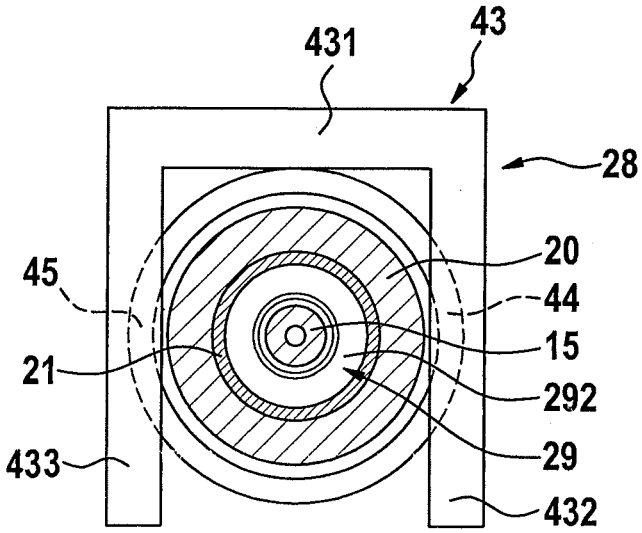
FIG. 9 shows a section along line IX-IX in FIG. 8.
Figure 10:
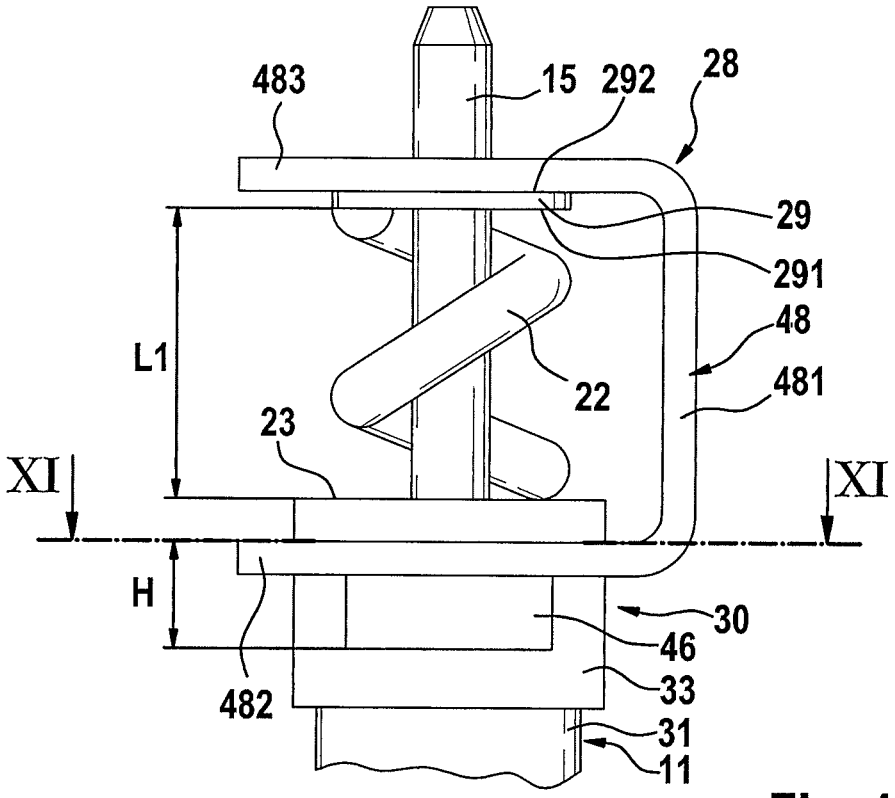
FIG. 10 a side view of the valve in the device, according to a fifth exemplary embodiment.
Figure 11:
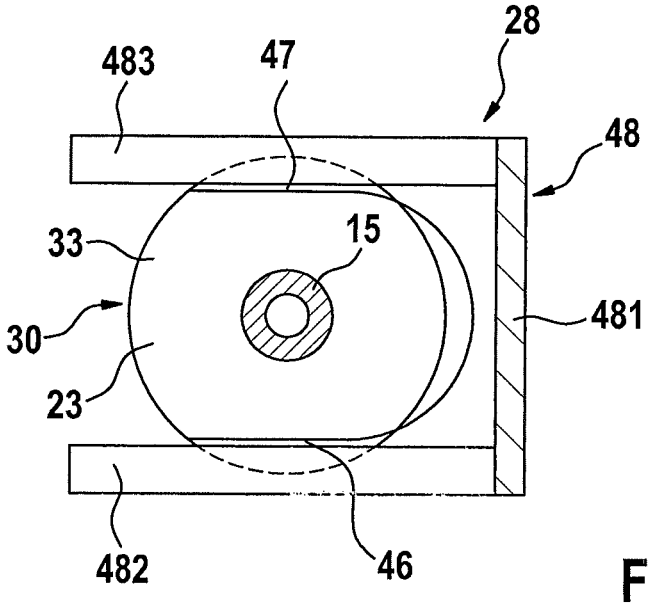
FIG. 11 a section along line XI-XI in FIG. 10.
Figure 12:
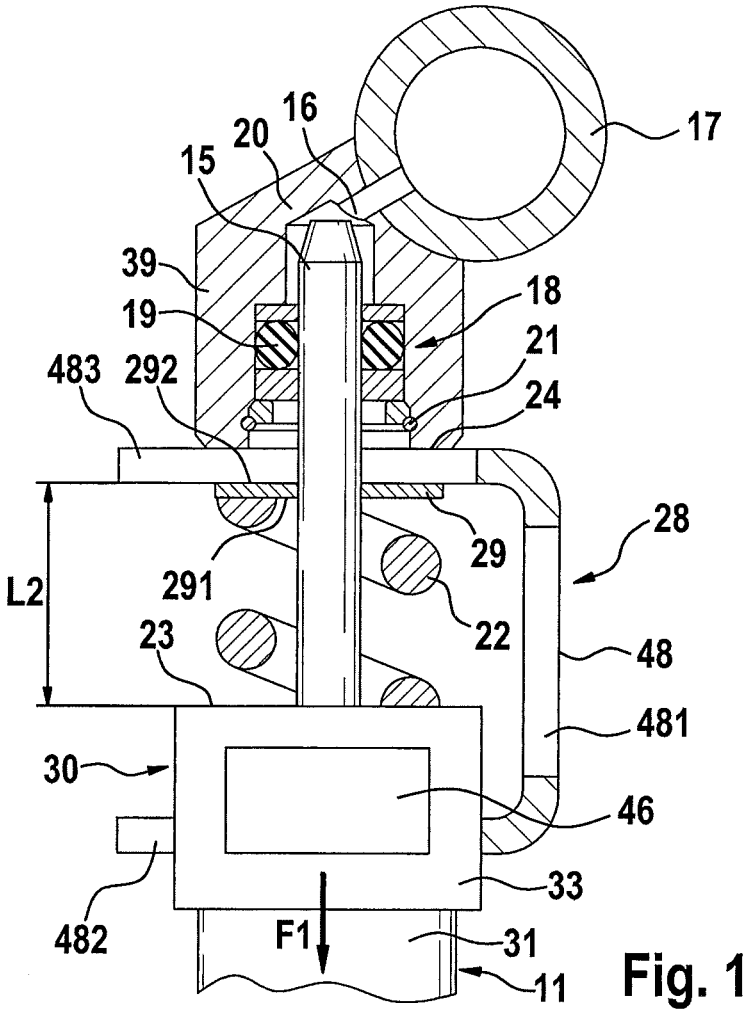
FIG. 12 shows a section corresponding to the section shown in FIG. 10, supplemented by the distributor shown in longitudinal section after final assembly with transfer of the holding-down force.
Figure 13:
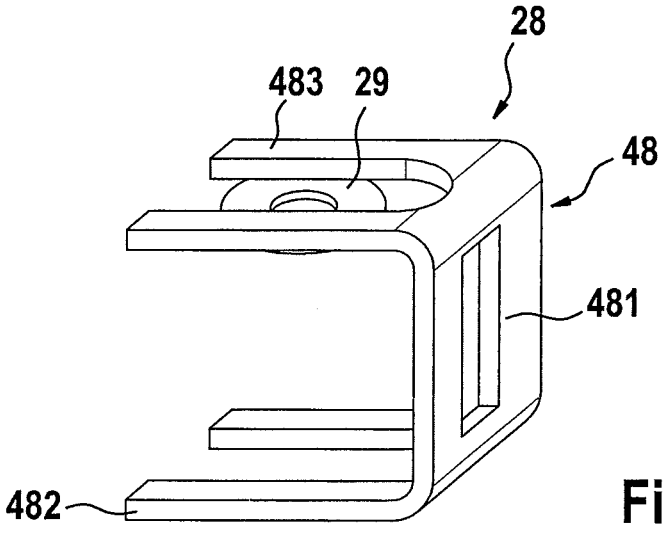
FIG. 13 a perspective representation of a securing member in the device according to FIG. 12.

In the exemplary embodiment shown in FIGS. 8 and 9, connecting body 30, or rather plastic part 33 has a pot-shaped region having a pot bottom 301 forming first support shoulder 23 for spring element 22, and a pot jacket 302 situated concentrically to connection piece 15, and securing member 28 has a clamp 43 having two clamp legs 432 and 433 connected by a crosspiece 431. The two clamp legs 432, 433 are inserted axially with form-locking into two transverse grooves 44 and 45 developed diametrically in the pot jacket 302 and engage over supporting disk 29 on its disk surface facing away from the spring element 22, outside second support region 292 for second support shoulder 24 on the side of the valve. Transverse grooves 44, 45, in this instance, are inserted into pot jacket 302 in such a way that the helical compression spring forming spring element 22 is compressed to working length L1 (FIG. 8). After the placement of valve 11 onto manifold 17, connecting cup 20 reaches through between the two clamp legs 432 and 433 and, together with second support shoulder 24, that is developed at the cup rim, lies against second support region 292 at support disk 29. Now, if manifold 17 is pushed further in the direction of cylinder head 12, then via support disk 29, prestressed spring element 22 is deflected inwards from L1 to L2 (as in FIG. 7), that is, the helical compression spring is compressed from working length L1 to working length L2, connection piece 15 in sealing region 18 within connecting cup 20 being displaced by path length a (FIG. 8).

In the exemplary embodiment shown in FIGS. 10 through 13, connecting body or plastic part 33 has a hollow cylinder region that concentrically surrounds connection piece 15, in whose cylinder wall two diametrically situated transverse grooves 46, 47 have been worked in having groove openings facing away from each other and an axial height of groove H. Securing member 28 has a bracket 48 having two fork-shaped bracket legs 482, 483. One bracket leg 482 is set into transverse grooves 46 and 47, in each case a fork tine of bracket leg 482 lying in one of transverse grooves 46, 47. The other bracket leg 483, using the fork tines, engages over support disk 29, on its disk surface facing away from spring element 22, on both sides of connection piece 15, namely, within second support region 292, for second support shoulder 24 on the manifold side. The length of axial crosspiece 481 is selected so that, in response lower bracket leg 482, lying against the upper groove legs of transverse grooves 46, 47, spring element 22 which is supported on first support shoulder 23 and on support disk 29, produces the prestressing force, that is, it compresses the helical compression spring to working length L1 in FIG. 10. The axial groove width or groove height H of transverse grooves 46, 47 is dimensioned in such a way that it corresponds to the sum of the displacement path of supporting disk 29 from position L1 (FIG. 10) to position L2 (FIG. 12) and the axial thickness of lower bracket leg 482 that engages in transverse grooves 46, 47. After the placement of valve 11 on manifold 17, because of pressing down of manifold 17, bracket 48 is displaced downwards via second support shoulder 24 that is developed at the cup rim of connecting cup 20, until lower bracket leg 482 lies against the lower groove sides of transverse grooves 46, 47. In this context, via supporting disk 29, bracket 48 shortens the working length of the helical compression spring from L1 (FIG. 10) to L2 (FIG. 12), and spring element 22 transfers spring force F1 to valve 11.

What is claimed is:

1. A device for holding down a valve for metering fuel in a cylinder head bore provided in a cylinder head of an internal combustion engine, the valve being inserted, by a connection piece, into a sealing region which presses against the connection piece on an outlet opening of a manifold which is able to be fixed on a cylinder head for supplying fuel, the device comprising:

a spring element clamped in between a first support shoulder on the valve side and a second support shoulder on the manifold side, the spring element transferring a holding-down force to the valve;

wherein the spring element is prestressed to a prestressing force which is reduced compared to the holding-down force, and the prestressed spring element is fixed on the valve using a securing member situated on the valve, wherein the spring element generates no spring force between the two support shoulders when the connection piece is pushed into the sealing region, and wherein the spring element is a helical compression spring.

2. The device as recited in claim 1, wherein the prestressing force of the prestressed spring element is set in such a way that a free path for a displacement of the connection piece which is present in the sealing region is sufficient to stress the spring element, by reducing an axial distance between the first and second support shoulders, from the prestressing force to the holding-down force.

3. The device as recited in claim 2, wherein:

the prestressed spring element is fixed using the securing member situated on the valve;

a supporting disk is situated concentrically to the connection piece and assigned to the spring element;

the supporting disk has, on disk surfaces facing away from each other, a first supporting region for the spring element and a second supporting region for the second support shoulder; and the supporting disk cooperates with the securing member.

4. The device as recited in claim 3, wherein the supporting disk is situated on the connection piece in an axially displaceable manner, and the securing member is formed by an axial stop for the supporting disk situated on the connection piece.

5. The device as recited in claim 4, wherein the axial stop is implemented using a spring ring which is set into an annular groove formed into the connection piece.

6. The device as recited in claim 4, wherein the axial stop is implemented using a radial shoulder formed on the connection piece, and spring projections are provided at radial inner edge of the supporting disk, the spring projections extending radially and engaging behind the radial shoulder.

7. The device as recited in claim 3, wherein:

the connection piece stands away axially from a connecting body which closes an end face of a valve housing of the valve; and the securing member is fixed on the connecting body.

8. The device as recited in claim 7, wherein the securing member has a plurality of snap-in hooks having hook legs and hook projections, and wherein the snap-in hooks are integrally formed on the connecting body in such a way that the hook legs extend parallel to the connection piece and the hook projections engage over a disk surface of the supporting disk facing away from the spring element outside the second support region for the second support shoulder.

9. The device as recited in claim 8, wherein the length of the hook legs is dimensioned to enable the hook projections to extend in axial grooves provided at the manifold when connecting the valve and the manifold.

10. The device as recited in claim 7, wherein:

the connecting body has a pot-shaped region having (i) a pot bottom forming the first support shoulder for the spring element, and (ii) a pot jacket situated concentrically to the connection piece; and the securing member has a clamp having two clamp legs connected to each other by a crosspiece, the two clamp legs being inserted axially in a form-locking manner into two transverse grooves formed diametrically in the pot jacket, and the two clamp legs engage over the supporting disk on a disk surface of the supporting disk facing away from the spring element outside the second supporting region for the second support shoulder.

11. The device as recited in claim 7, wherein:

the connecting body has a hollow cylindrical region concentrically surrounding the connection piece;

the connection piece has two transverse grooves which (i) are diametrically formed into the cylinder wall, (ii) have groove openings facing away from each other, and (iii) have an axial groove height which is adjusted to an inward deflection of the spring element required to transfer the holding-down force; and the securing member has a bracket having two fork-shaped bracket legs connected to each other by an axial crosspiece, one bracket leg being inserted into the transverse grooves and the other bracket leg engaging over the supporting disk on a disk surface of the supporting disk facing away from the spring element, within the second supporting region for the second support shoulder.

12. The device as recited in claim 7, wherein:

at least one crosspiece extending parallel to the connection piece is formed on the connecting body; and at least one axial groove is formed on the manifold for introducing the crosspiece.

13. The device as recited in claim 7, wherein:

the connecting body has a metallic connecting piece set into the valve housing;

the metallic connecting piece of the connecting body has a supply bore extending from the connection piece and a plastic part surrounding the connection piece;

the first support shoulder and the securing member are assigned to the connection piece;

the plastic part is mounted on the metallic connecting piece of the connecting body as a separate module component; and the plastic part is one of (i) held on the metallic connecting piece of the connecting body using the spring element, or (ii) sprayed on the metallic connecting piece as a plastic extrusion.

* * * * *